United States Patent [19]

Scheffer

[11] Patent Number: 4,932,849

[45] Date of Patent: Jun. 12, 1990

[54] MANUAL AIR PUMP FOR TWO WHEEL TIRES

[75] Inventor: Walter Scheffer, Sundern/Sauerland, Fed. Rep. of Germany

[73] Assignee: Firma Karl Scheffer-Klute GmbH & Co., Sundern/Sauerland, Fed. Rep. of Germany

[21] Appl. No.: 286,382

[22] Filed: Dec. 16, 1988

[30] Foreign Application Priority Data

Dec. 18, 1987 [DE] Fed. Rep. of Germany ..... 3742998
Jun. 10, 1988 [DE] Fed. Rep. of Germany ..... 3819771

[51] Int. Cl.[5] ..... F04B 33/00

[52] U.S. Cl. ..... 417/568; 417/478; 137/38

[58] Field of Search ..... 417/442, 502, 568; 137/38

[56] References Cited

U.S. PATENT DOCUMENTS

| | | | |
|---|---|---|---|
| 247,142 | 9/1881 | Woods | 417/478 |
| 2,933,095 | 4/1960 | Rumsey | 137/38 |
| 4,202,495 | 5/1980 | Kränzel | 137/38 |
| 4,417,861 | 11/1983 | Tolbert | 417/478 |

FOREIGN PATENT DOCUMENTS

| | | |
|---|---|---|
| 380975 | 9/1923 | Fed. Rep. of Germany . |
| 544366 | 9/1922 | France . |
| 963471 | 6/1951 | France . |

OTHER PUBLICATIONS

*Bicycling* Magazine, Feb. 1989, pp. 145–147, by Jim Langley.

*Primary Examiner*—Michael Koczo
*Assistant Examiner*—Robert N. Blackmon
*Attorney, Agent, or Firm*—Michael J. Striker

[57] ABSTRACT

A manual air pump for two wheel tires comprises means forming a pressure chamber, a head part, a first connecting element for connecting with a bicycle valve and a second connecting element for connecting with an air pin of a motorcycle valve, the head having a connecting passage which connects the first connecting element with the second connecting element and communicates with the pressure chamber, and a closing body arranged movably in the connecting passage so that under the action of its own weight it can close the first connecting element or the second connecting element in one of two different positions of the head.

15 Claims, 4 Drawing Sheets

MANUAL AIR PUMP FOR TWO WHEEL TIRES

BACKGROUND OF THE INVENTION

The present invention relates to a manual air pump for two wheel tires. More particularly it relates to a manual air pump which has a head and two oppositely located connecting elements for connecting a pump chamber with a respective one of the wheel tires.

Manual air pumps of the above mentioned general type are known in the art. Such pumps are used for pumping wheels of bicycles as well as wheels of motorized bicycles, for which purpose two connecting elements for respective valves are provided. Thereby different valves can be connected with the same pump and the connecting elements can be fitted directly on the valve. It is well known during the utilization of a manual pump to bring the valve on the wheel in upper position so that it extends upwardly and the used connecting element of the pump assumes an upwardly directed position.

The French document FR-PS 544,366 discloses a pump head for power vehicle wheels with two mating elements for valves of different sizes. The conversion of the air stream from one to the other connecting element is performed by rotating of a valve plug. The German document GE-PS 380,975 discloses a manual pump for pumping vehicle tires. The different connecting elements are received in a transverse pipe in the head which admits the pumped air through an opening in the tubular wall. The transverse pipe is formed as a cylinder with a piston which guides the pumped air to one or another connecting element depending on the position of the piston at one or another side of the supply opening. The displacement of the piston is performed by screwing-in of a hose in one of the connecting elements. Thereby in this known manual air pump only one connecting element for direct fitting on a valve is suitable. Finally, the French document FR-PS 983,471 discloses a connecting device for pumping tires with a cylinder which on each end is provided with a connecting element connected with a supply passage and which also has a piston in which to supply the air to one or another connecting element depending on its position relative to the supply passage. The displacement of the piston is performed pneumatically. The known arrangements are suitable for automobile tires.

SUMMARY OF THE INVENTION

Accordingly, it is an object of the present invention to provide a manual air pump for two wheel tires in which one connector can be fitted directly on a standard bicycle valve while another connector can be directly fitted on a motorcycle valve with a ventilating pin or so-called Schrader valve, and an automatic conversion of the manual air pump between these operations is provided.

In keeping with these objects and with others which will become apparent hereinafter, on feature of the present invention resides, briefly stated, in a manual air pump which has a pump chamber, a connecting passage, two connectors which communicate with the connecting passage, and a closing member movable in the connecting passage so as to block a respective one of said connectors in a respective one of two different positions of the pump.

The connectors on the head of the manual air pump of the invention are formed in a known manner so that one of them can be fitted on a standard bicycle valve, while the other valve can be fitted on a valve with a ventilating pin or a so-called Schrader valve which is used by many motorcycles. Automatically without any complicated adjustments the non-used lower connector is blocked by a free fall of the closing member under the action of its own weight. The connecting passage in the head is formed so that the closing member can freely fall in it without any obstacles. In a respective position it abuts against a seat associated with a respective one of the connectors when the connecting passage assumes only approximately vertical position.

In accordance with another feature of the present invention, the closing member can be formed as a spherical member cooperating with the seat, wherein the spherical member can be formed as a metal ball while the seats can be formed on a rubber bush or a rubber ring. The rubber bush simultaneously serves for sealing of the respective valves.

In accordance with a further feature of the present invention, the closing member can be formed as a cylindrical member of rubber or synthetic plastic material and cooperate with the respective seat formed as circular edges.

In accordance with still a further feature of the present invention, the elements of both connectors can be held by a flat ring which is provided with a threaded pipe screwable into a respective threaded opening of the head. In this case a relatively low radial expansion of the pump head occurs.

Finally, in accordance with the present invention a further closing member can be arranged in the region of a transition between the pressure chamber and the connecting passage of the pump for preventing a return flow.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
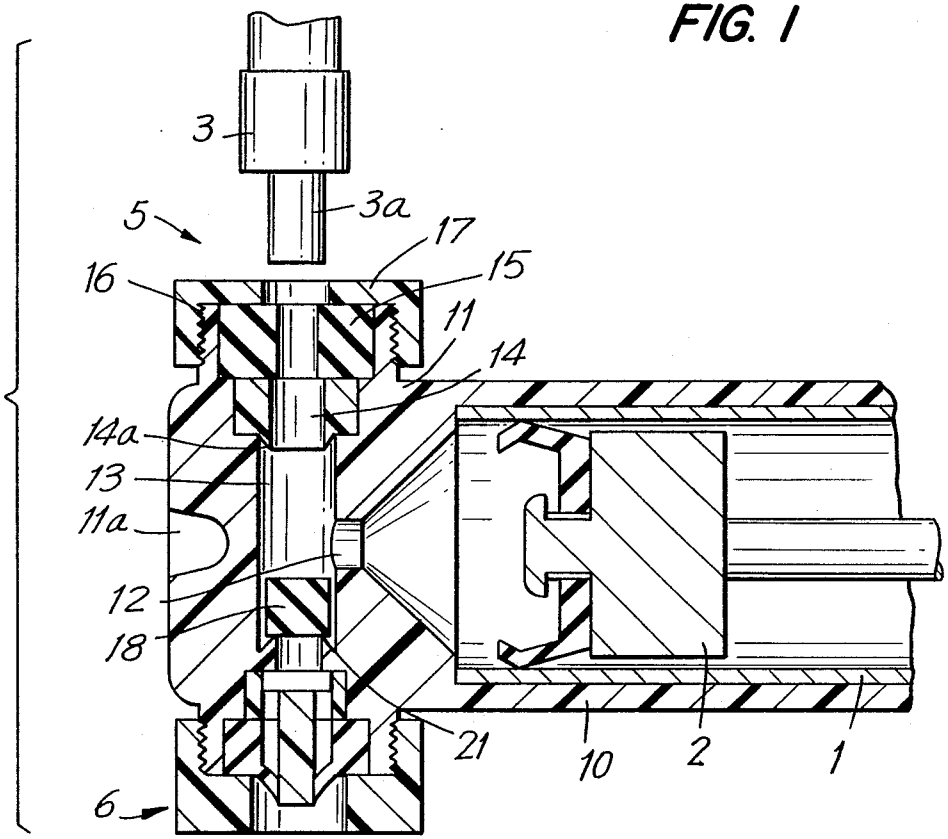
FIG. 1 is a view showing a section of a manual air pump in accordance with the present invention in a position which is suitable for cooperation with a standard bicycle valve.
Figure 2:
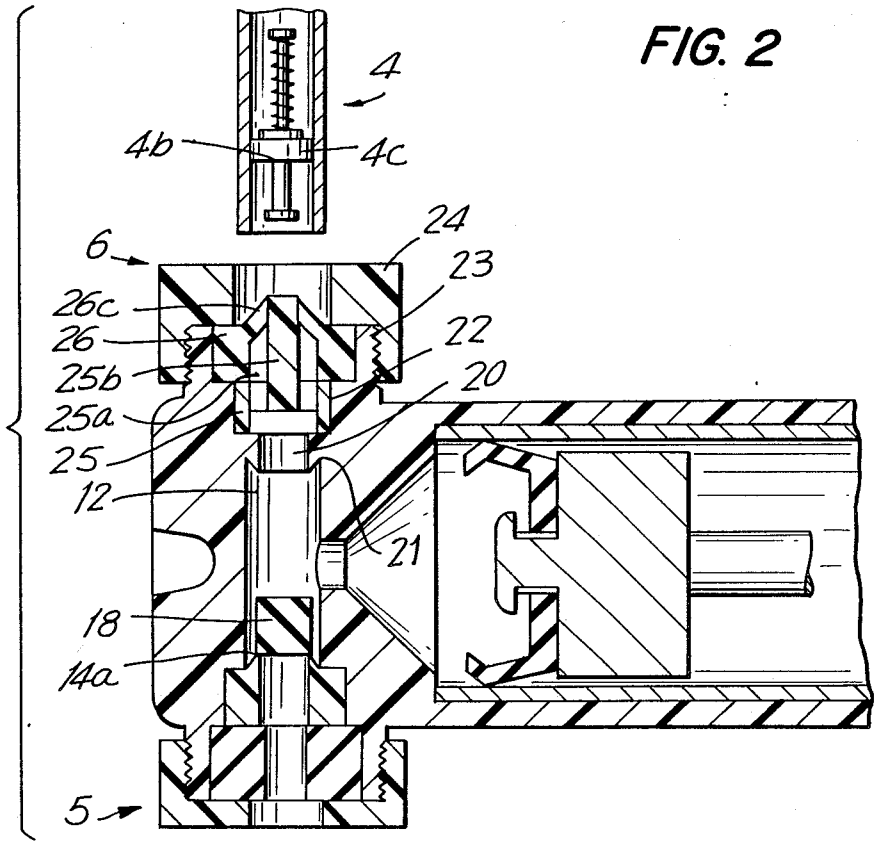
FIG. 2 is a view showing the inventive manual air pump in a position suitable for cooperation with a motorcycle valve.

A manual air pump in accordance with the first embodiment is shown in FIG. 1 and 2. It has a pump tube or cylinder 1 provided with a piston 2. At its front side the pump tube 1 is closed by a tubular piece 10 which is composed of synthetic plastic material and provided with a head 11 formed on it. The head has a recess 11*a* for receiving a holder of a bicycle. The head 11 also has a radial connecting passage 13 which communicates with a pressure chamber through a short axial passage 12. A connector 5 for a bicycle valve with associated elements is arranged on one end of the connecting passage 13. In FIG. 1 the connector 5 is located on the top, ready for receiving the standard bicycle valve 3.

A connector 6 for a motorcycle valve or so-called Schrader valve is located in FIG. 1 at the bottom side.

A rubber bush 15 is provided for receiving a connecting pipe 3*a* of the bicycle valve and simultaneously for sealing. It is arranged in the bicycle valve connector 5 and is received in a shaped threaded pipe 16. A cap screw 17 which is screwed on the threaded pipe 16 holds the rubber bush 15 in its position. The rubber bush is in communication with the connecting passage 13 through a passage 14. The passage 14 is formed in a cylindrical metal ring which is received in a respective recess of the head. A circular valve seat 14*a* is formed inwardly on the metal ring 14.

A corresponding valve seat 21 is provided at a transition to the connector for the motorcycle valve. In this case the valve seat 21 is formed on a passage 20 in the head.

The connecting passage 13 displaceably receives a closing body for example of rubber of synthetic plastic material, which seats on one of the seats 14*a* or 21 under the action of its own weight. In the position shown in FIG. 1 it sits on the lower seat 21 for transition to the connection for the motorcycle valve. In this position the closing body which is identified with reference numeral 18 guarantees the closing of the motorcycle valve, so that the pumped air can flow only upwardly through the connector 5, but cannot flow downwardly through the connector 6 to the motorcycle.

FIG. 2 shows the position in which pumping is performed through the motorcycle valve with the connector 6 in an upper position. The connector 5 for the bicycle valve is in the lower position and blocked by the closing body 18.

The connector elements for the motorcycle valve include in a known manner a rubber ring 26 which is received by a threaded pipe 23 and held by a cap screw 24. The rubber ring 26 has a circular sealing lip 26*a*. The sealing lip permits escape of air which blocks the returned stream in that it abuts against an axial ventilating pin 25*b*. The ventilating pin is a part of an insert ring 25 which is composed of synthetic plastic material and connected with the ventilating pin through a web 25*a*. The insert ring is received in a corresponding recess 22. The transition from the insert ring 25 to the connecting passage 13 is performed through a narrow passage 20 with a valve seat 21 formed on it.

Figure 3:
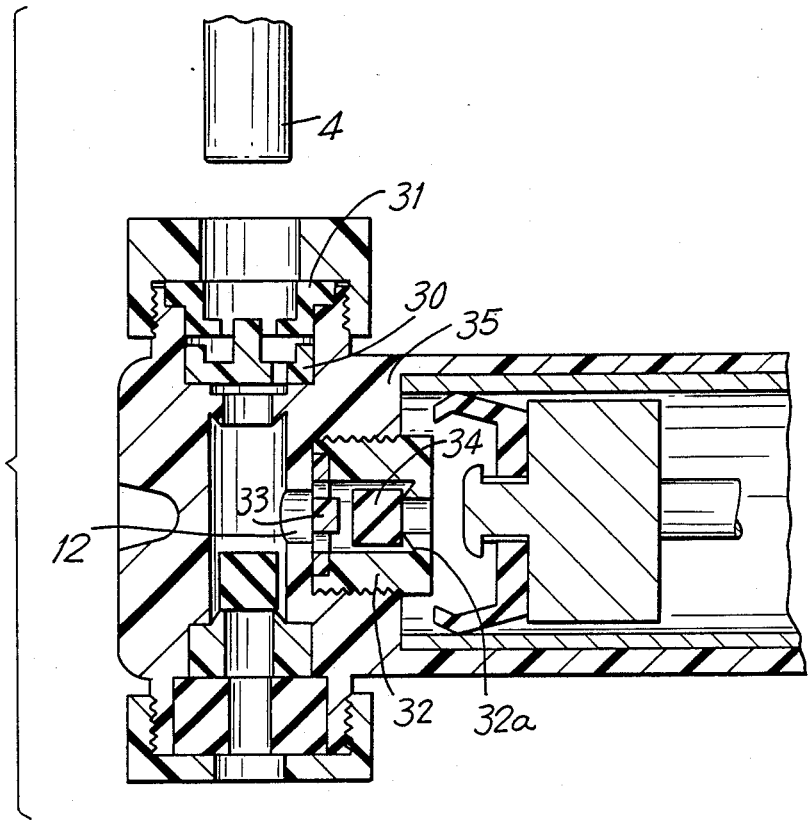
FIG. 3 is a view showing the manual air pump in accordance with a further embodiment of the present invention with a return flow blocking element.

In the embodiment of FIG. 3 the connector 6*a* for the motorcycle valve is formed without a return flow blocking. In principle, with the closure 6*a*, similarly to the closure 6, a ventilating pin is provided and a rubber ring which is formed as a rubber ring 31 in the connector 6*a* has no sealing lip. Moreover, the air can escape around the ventilating pin which is a part of a disc 30, and therefore flow back.

In the pump head of FIG. 3 an axial return flow blocking is formed as an axially movable cylindrical closing body 34 which is received in an axial passage 32*a*. During application of a pump pressure the closing body 34 is lifted from its seat 32*a* and abut against a perforated disc 33. The air can flow into the radial connecting passage 13 and from there to the connectors. If an air pressure acts from outside, the closing member 34 which can be formed similarly to the closing member 18 is pressed against the seat 32*a*. In this manner, the axial passage and thereby the return flow of the air into the pump chamber is blocked.

The axial passage with the formed seat 32*a* is provided in a bush 32. The bush is screwed in an inner thread of the pump head 35. The perforated disc 33 is received by the bush 32 and serves as an abutment for the closing body 34 when it is lifted from its seat.

Figure 4:
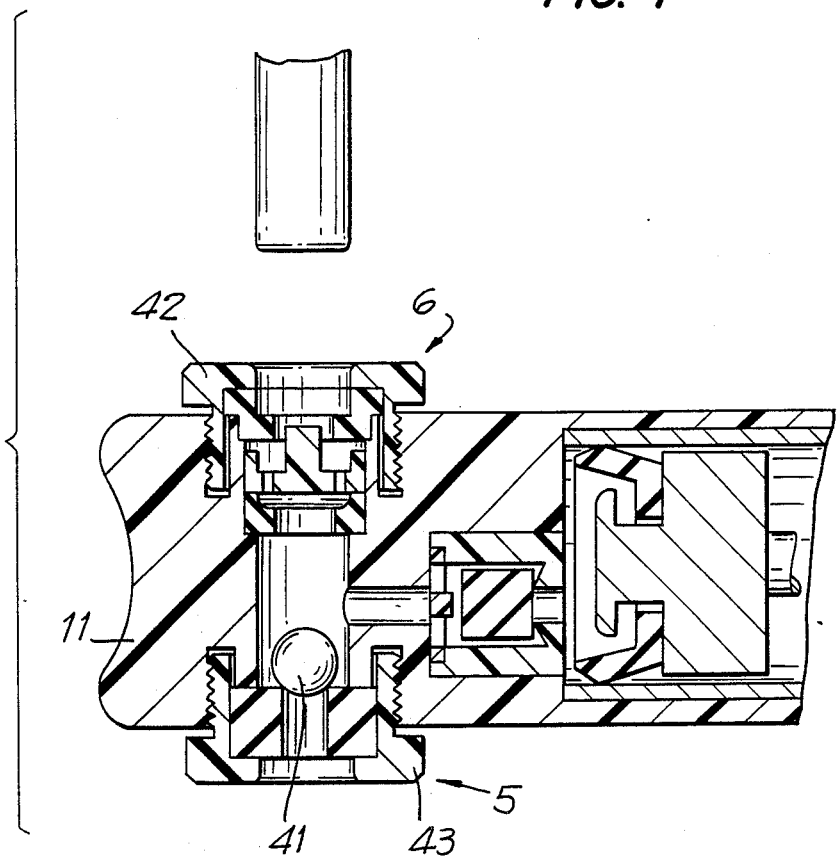
FIG. 4 is a view showing still a further embodiment of the present invention with a differently formed closing member and valve connector retaining elements.

FIG. 4 shows a further modification of the invention. Here a closing member is formed as a spherical member and identified with reference numeral 41. Also, elements 42 and 43 of the connectors 6 and 5, which hold the rubber bushes are formed as cap screws different from the cap screws of the previous embodiment. Here the cap screws 42 and 43 are provided with outer threads and screwed into the head 11.

It will be understood that each of the elements described above, or two or more together, may also find a useful application in other types of constructions differing from the types described above.

While the invention has been illustrated and described as embodied in a manual pump for two wheel tires, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A manual air pump for two wheel tires, comprising means forming a pressure chamber; a head; a first connecting element for connecting with a bicycle valve and a second connecting element for connecting with an air pin of a motorcycle valve, said head having a first connecting passage which connects said first connecting element with said second connecting element and communicates with said pressure chamber, and a second passage through which said first connecting passage communicates with said pressure chamber; a closing body arranged movably in said first connecting passage so that under the action of its own weight it can close said first connecting element or said second connecting element in one of two different positions of said head; and a further cylindrical closing body which is movable in said second passage so that, when an air pressure acts from outside, said further closing body blocks said second passage and, when an air pressure acts from inside, said further closing body opens said second passage; said second passage being provided with a seat arranged so that, when an air pressure acts from outside, said further closing body abuts against said seat to block said second passage and, when an air pressure acts from its inside, said further closing body is lifted from said seat to open said second passage.

2. A manual air pump as defined in claim 1, wherein said head has an axis extending between said first and second connecting elements, said first connecting passage extending radially to said axis.

3. A manual air pump as defined in claim 1; and further comprising two seats each associated with a respective one of said connecting elements, said closing body being movable to abut against a respective one of said seats for closing a respective one of said connecting elements in a respective one of said two positions.

4. A manual air pump as defined in claim 3, wherein at least one of said seats is formed as a rubber bush.

5. A manual air pump as defined in claim 3, wherein at least one of said seats is formed as a rubber ring.

6. A manual air pump as defined in claim 1, wherein said closing body is formed as a spherical member.

7. A manual air pump as defined in claim 1, wherein said closing body which is movable in said first connecting passage is formed as a cylindrical body.

8. A manual air pump as defined in claim 1, wherein said head has an axis extending between said connecting elements, said first connecting passage being formed as a radial passage while said second passage which connects said first connecting passage with said pressure chamber is formed as an axial passage.

9. A manual air pump as defined in claim 1, wherein each of said seats is formed as a circular edge provided directly on said head as one piece therewith.

10. A manual air pump as defined in claim 3; and further comprising a ring-shaped member which is inserted in said head, each of said seats being formed on said ring-shaped member.

11. A manual air pump as defined in claim 1; and further comprising two rings each arranged to hold a respective one of said connecting elements, said head being provided with two threaded openings, and each of said rings being provided with a threaded pipe which is screwable in a respective one of said threaded openings.

12. A manual air pump as defined in claim 1; and further comprising two rings each holding a respective one of said connecting elements, said head being provided with two threaded pipes, each of said rings being provided with a threaded opening and screwed on a respective one of said threaded pipes.

13. A manual air pump for two wheel tires, comprising means forming a pressure chamber; a head; a first connecting element for connecting with a bicycle valve and a second connecting element for connecting with an air pin of a motorcycle valve, said head having a connecting passage which connects said first connecting element with said second connecting element and communicates with said pressure chamber; a closing body arranged movably in said communicating passage so that under the action of its own weight it can close said first connecting element or said second connecting element in one of two different positions of the head; a hollow bush arranged in a transition between said pressure chamber and said connecting passage; and a further closing body which is movable in said bush for opening said bush for an air flow from said pressure chamber to said connecting passage and closing said bush from a reverse flow from said connecting passage to said pressure chamber.

14. A manual air pump as defined in claim 13; and further comprising means forming a seat so that said further closing body abuts against said seat under the action of the return flow of air but is lifted from said seat under the action of air flow flowing from said pressure chamber to said connecting passage.

15. A manual air pump as defined in claim 14, wherein said seat is formed as a circular edge, said further closing body is formed as a cylindrical member composed of a material selected from the group consisting of rubber and a synthetic plastic material.

* * * * *